US008777652B2

(12) United States Patent
Durand

(10) Patent No.: US 8,777,652 B2
(45) Date of Patent: Jul. 15, 2014

(54) FIXTURE WITH ELECTRICAL CONNECTIONS AND SYSTEMS FOR SEPARABLE MECHANICAL ATTACHMENT

(75) Inventor: Francois Durand, Magny les Hameaux (FR)

(73) Assignee: MDBA France, Paris (FR)

( * ) Notice: Subject to any disclaimer, the term of this patent is extended or adjusted under 35 U.S.C. 154(b) by 157 days.

(21) Appl. No.: 13/636,795

(22) PCT Filed: Mar. 29, 2011

(86) PCT No.: PCT/FR2011/000184

§ 371 (c)(1),
(2), (4) Date: Sep. 24, 2012

(87) PCT Pub. No.: WO2011/121192

PCT Pub. Date: Oct. 6, 2011

(65) Prior Publication Data

US 2013/0012057 A1 Jan. 10, 2013

(30) Foreign Application Priority Data

Apr. 1, 2010 (FR) ..... 10 52455

(51) Int. Cl.

| | |
|---|---|
| ***H01R 13/627*** | (2006.01) |
| ***H01R 13/621*** | (2006.01) |
| ***H01R 13/639*** | (2006.01) |
| ***H01R 13/658*** | (2011.01) |
| ***H01R 13/516*** | (2006.01) |

(52) U.S. Cl.

CPC ..... *H01R 13/6215* (2013.01); *H01R 13/6395* (2013.01); *H01R 13/658* (2013.01); *H01R 13/516* (2013.01); *H01R 13/621* (2013.01)

USPC ..... 439/362

(58) Field of Classification Search

CPC ..... H01R 13/6215; H01R 13/658; H01R 13/6395; H01R 13/516; H01R 13/621

USPC ..... 439/362, 675

See application file for complete search history.

(56) References Cited

U.S. PATENT DOCUMENTS 2,998,643 A * 9/1961 Erdmann ..... 29/229
4,061,969 A * 12/1977 Dean ..... 324/756.07

(Continued)

FOREIGN PATENT DOCUMENTS

| | | |
|---|---|---|
| EP | 0 363 242 A1 | 4/1990 |
| EP | 0467 295 A1 | 1/1992 |
| EP | 2 182 224 A1 | 5/2010 |

OTHER PUBLICATIONS

International Search Report completed May 26, 2011 and mailed Jun. 6, 2011 from corresponding International Application No. PCT/FR2011/000184 filed Mar. 29, 2011 (3 pages).

(Continued)

*Primary Examiner* — Amy Cohen Johnson
*Assistant Examiner* — Vladimir Imas
(74) *Attorney, Agent, or Firm* — Klein, O'Neill & Singh, LLP

(57) ABSTRACT

The fixture intended for assembling two cylindrical components with a common longitudinal axis comprises two support plates attached respectively facing one another to the components at the periphery thereof, three electrical connectors, each in two parts, parallel to one another and aligned in a circular arc (AC) with respect to said longitudinal axis on said plates each of which bears the corresponding parts of the connectors, and, between the three connectors and parallel thereto, two separable-attachment systems fixedly connecting said plates by locking said parts of the connectors. Advantageously, the two separable-attachment systems are positioned offset from said circular arc (AC), on the inside thereof, and in projection perpendicular to said longitudinal axis, and lie in the triangular plane formed by the three electrical connectors aligned in a circular arc.

9 Claims, 5 Drawing Sheets

(56) References Cited

U.S. PATENT DOCUMENTS

| | | | | | |
|---|---|---|---|---|---|
| 4,115,735 | A | * | 9/1978 | Stanford | 324/750.2 |
| 4,187,759 | A | | 2/1980 | Berstein et al. | |
| 4,252,150 | A | * | 2/1981 | Morley et al. | 137/798 |
| 4,366,965 | A | * | 1/1983 | Rhodes | 280/421 |
| 4,437,792 | A | * | 3/1984 | Durand et al. | 405/198 |
| 4,548,589 | A | * | 10/1985 | Mayer et al. | 445/4 |
| 4,556,270 | A | * | 12/1985 | Schutzle et al. | 439/359 |
| 4,567,924 | A | * | 2/1986 | Brown | 141/207 |
| 4,580,340 | A | * | 4/1986 | Shields | 29/861 |
| 4,626,780 | A | * | 12/1986 | Powers et al. | 324/750.03 |
| 4,800,473 | A | * | 1/1989 | Tremblay | 362/223 |
| 4,810,981 | A | * | 3/1989 | Herstein | 333/27 |
| 4,821,161 | A | * | 4/1989 | Koontz | 362/364 |
| 4,842,526 | A | * | 6/1989 | Stukalin et al. | 439/42 |
| 4,932,874 | A | * | 6/1990 | Hollopeter et al. | 439/133 |
| 4,971,422 | A | * | 11/1990 | Herse | 385/55 |
| 4,990,044 | A | * | 2/1991 | Kimak | 411/427 |
| 5,190,465 | A | * | 3/1993 | Davidge et al. | 439/304 |
| 5,219,318 | A | * | 6/1993 | Vranish | 483/16 |
| 5,334,043 | A | * | 8/1994 | Dvorak et al. | 439/482 |
| 5,660,408 | A | * | 8/1997 | Johnson | 280/420 |
| 5,839,912 | A | * | 11/1998 | Schekalla et al. | 439/157 |
| 6,261,123 | B1 | * | 7/2001 | Kruger et al. | 439/511 |
| 6,289,818 | B1 | | 9/2001 | Mueller et al. | |
| 6,373,922 | B1 | * | 4/2002 | Dalpe et al. | 378/136 |
| 6,471,522 | B2 | * | 10/2002 | Kendall | 439/42 |
| 6,600,666 | B2 | * | 7/2003 | Lott et al. | 361/826 |
| 6,639,498 | B2 | * | 10/2003 | Shimada et al. | 336/96 |
| 6,703,853 | B1 | * | 3/2004 | Wee et al. | 324/756.02 |
| 6,720,527 | B2 | * | 4/2004 | Gadamus et al. | 219/130.1 |
| 6,722,918 | B2 | * | 4/2004 | McCoy | 439/533 |
| 6,758,142 | B1 | | 7/2004 | Seaquist | |
| 7,127,780 | B2 | * | 10/2006 | Kimoto | 24/90.1 |
| 7,128,540 | B2 | * | 10/2006 | Tadano et al. | 417/410.3 |
| 7,150,424 | B2 | * | 12/2006 | Hopper | 242/375.1 |
| 7,478,775 | B2 | * | 1/2009 | Hopper | 242/375.1 |
| 7,500,865 | B2 | * | 3/2009 | Natter et al. | 439/362 |
| 7,744,399 | B1 | * | 6/2010 | Gibbs et al. | 439/362 |
| 7,815,450 | B1 | * | 10/2010 | Chen et al. | 439/218 |
| 7,887,342 | B1 | * | 2/2011 | Yu | 439/131 |
| 8,282,410 | B2 | * | 10/2012 | Siebens et al. | 439/362 |
| 8,500,721 | B2 | * | 8/2013 | Jinno | 606/1 |
| 2006/0227535 | A1 | * | 10/2006 | McArthur | 362/148 |
| 2011/0217110 | A1 | * | 9/2011 | Argillier et al. | 403/33 |

OTHER PUBLICATIONS

Written Opinion completed May 26, 2011 and mailed Jun. 6, 2011 from corresponding International Application No. PCT/FR2011/000184 filed Mar. 29, 2011 (11 pages).

* cited by examiner

FIXTURE WITH ELECTRICAL CONNECTIONS AND SYSTEMS FOR SEPARABLE MECHANICAL ATTACHMENT

CROSS-REFERENCE TO RELATED APPLICATIONS

This is a national phase application under 35 U.S.C. §371 of PCT Application No. PCT/FR2011/000184, filed Mar. 29, 2011, which claims the benefit of French application No. 1052455, filed Apr. 1, 2010, the contents of each of which are expressly incorporated herein by reference.

FIELD OF ART

The present device, system, and method relate to a fixture with electrical connections and separable mechanical attachment systems, intended for holding assembled two cylindrical components one to another and for allowing, further to a given order, the separation thereof through a relative axial movement between two components initiated by the attachment systems.

Such a fixture can find applications in numerous technical fields once it is desired to perform a separation of two previously assembled components, at a precise moment, being adapted to be controlled.

BACKGROUND

Prior art fixture can be implanted into a piece of ammunition including a vector, such as a missile. Indeed, it is known that some ammunition parts must be separated from each other upon firing and during the flight trajectory. That is in particular the case between the shell base or the lower part of the piece of ammunition and the acceleration and rocking system of the missile being attached in particular between them by such specific fixture bearing electrical connectors and separable mechanical attachment systems, and arranged within an internal ring space provided between the shell base and the acceleration system.

The electrical connectors serve to establish the communication (information transfer) between the acceleration and rocking system of the missile and the firing facility and must be consequently perfectly connected, and then separated by the mechanical attachment systems according to the orders being transmitted.

For example, a known fixture for assembling two cylindrical components with a common longitudinal axis, usually comprises:

- two support plates respectively inserted facing one another on the components substantially on the periphery of the latter;
- at least three electrical connectors each in two parts, mounted in parallel between them and aligned in a circular arc with respect to said longitudinal axis on said support plates, each of them bearing the corresponding parts of the connectors, and
- between the three electrical connectors, parallel to the latter, two separable mechanical attachment systems fixedly connecting said support plates by locking said parts of the connectors.

The grouping of the three electrical connectors on a same single fixture, moreover aligned on a common circular arc with the attachment systems arranged symmetrically with the connectors, on said circular arc, leads to occupy a minimum volume between the components with in addition an important weight gain and a lesser performance complexity, in comparison with a design with three distinct fixtures for the respective connectors being distributed by 120° with each other and provided then with two attachment systems symmetrically arranged for each electrical connector.

Although giving satisfactory results, such compact fixture with three electrical connectors and two mechanical attachment systems can present some disadvantages, in particular, upon the positioning of the electrical connections, when clamping the attachment systems on the support plates on which the respective parts of the connectors are fastened and which are coming closer to each other.

Indeed, as both electrical end connectors being identical between them are dimensionally bigger than the central electrical connector, the stiffness to be overcome so as to ensure the total connection between the two parts of these end connectors is then well higher than the one of the central connector. Such stiffness being determined by connector manufacturers depending on various parameters (current, environment, size, etc.), is given by a rubber element or carpet arranged between the two parts and which has to be pressed to ensure the sealing of the electrical connection of the connectors. So, as this stiffness is bigger at the level of the end connectors and that the connecting systems are on the same circular arc as the connectors, upon the positioning of the fixture during the clamping of the attachment systems while crushing the sealing elements, the axial efforts exerted by the systems tend to rock the mobile support plate with respect to the other support plate so that the so obtained fixture is not perfectly correct, which is not desirable in the application in question.

SUMMARY

The present device, system, and method aim to remedy such drawbacks.

For that purpose, the fixture with electrical connections and separable mechanical attachment systems for assembling two cylindrical components of a common longitudinal axis, of the type such as previously defined, is remarkable according to the device, system, and method in that both separable attachment systems are located being offset from said circular arc, on the internal side of the latter and are arranged, in a projection perpendicular to said longitudinal axis, in the triangular plane formed by the three electrical connectors being aligned in a circular arc.

Thus, thanks to the device, system, and method, the axial efforts delivered by the attachment systems to engage the parts of the connectors and especially overcome the stiffness of the end connectors and lock the fixture, cross perpendicularly through the triangular plane demarcated by the three connectors and no more outside the latter, thereby avoiding the rocking risks for the mobile support plate with respect to the fixed support plate.

Preferably, the fixture comprises moreover an axial abutment parallel to the separable mechanical attachment systems and arranged between the two support plates to form with both separable attachment systems a plane being parallel to the triangular plane formed by the three electrical connectors. The distance between those two planes is further calibrated so as to allow the appropriate compression effort on the sealing elements provided between the parts of the connectors, guarantying the electrical connections.

Thus, an action of the type plane against plane is obtained of the attachment systems with an axial abutment on the support plates on which the respective parts of the electrical connectors are fastened, being aligned in a circular arc. The rocking risk is then totally cancelled.

In particular, said axial abutment is located in a projection perpendicular to said longitudinal axis ahead the central electrical connector beyond said circular arc on the side being external to the latter. And, in a preferred embodiment, said axial abutment is present under the form of a stem fixedly attached by the ends thereof between the two support plates. Furthermore, the two attachment systems are preferably located closer to the two electrical end connectors.

In a preferred embodiment, each separable mechanical attachment system comprises an attachment mechanism for said components and a control device for said attachment mechanism so as to cause the separation of said components, said attachment mechanism being provided with an elastic deformation and comprising according to a longitudinal axis at least:

a stem having an enlarged end with a longitudinally slit spherical head being elastically deformable and fastened, on the other end thereof, to the plate of one of said components;

a needle being axially movable, an end of which is inserted into said spherical head of the stem to maintain it in an open position and the other end of which is connected to said control device; and a body with an axial hole, attached to the plate of the other component and surrounding said cooperating ends of the stem and the needle, while being axially attached to the latter and comprising in said hole an axial ring abutment against which said spherical head of the stem applies; and said control device being moved according to an axial displacement according to said longitudinal axis and acting on said needle of the attachment mechanism to deviate it from said enlarged end with spherical head of the stem and, through the action of said abutment of the body attached to said needle being moved, to switch said elastically deformable spherical head from its open position to a closed position and allow the relative passage of said stem through said abutment of the body.

Consequently, the combination of the elasticity of the end with the enlarged spherical head of the stem and the axial displacement of the needle moved by the control device is used to, on the one side, fasten the two components by the plates and the connectors and, on the other side, to separate them with a quite weak separation effort depending on the elasticity of the enlarged end to switch from its initial open position to its closed position.

Preferably, the attachment of said needle to said control device comprises a fastening nut receiving the threaded end of the needle opposite the one inserted into said stem, and a screw of said device, and around said screw, between said control device and the fastening nut, a compression spring is provided to axially hold forcibly in position said needle in the spherical head of the stem. Thus, in case of a vibratory movement or similar, in addition to the pinching effort of the slit and elastic spherical head, the spring prevents any untimely unlocking of the needle of the spherical head.

In particular, said spherical head comprises at least two slots arranged in perpendicular longitudinal planes by separating said spherical head in four identical elastically deformable quarters, at the center of which the corresponding end of said needle can be inserted to hold it in an initial open position.

And said abutment of the body defines a spherical annular bearing being complementary of the spherical head and is formed by an annular element mounted around said stem and attached by screwing to said body.

BRIEF DESCRIPTION OF THE DRAWINGS

The Figs. of the accompanying drawing will make well understood how aspects of the invention can be implemented. On these Figs., identical reference annotations denote similar elements.

DETAILED DESCRIPTION

Figure 1:
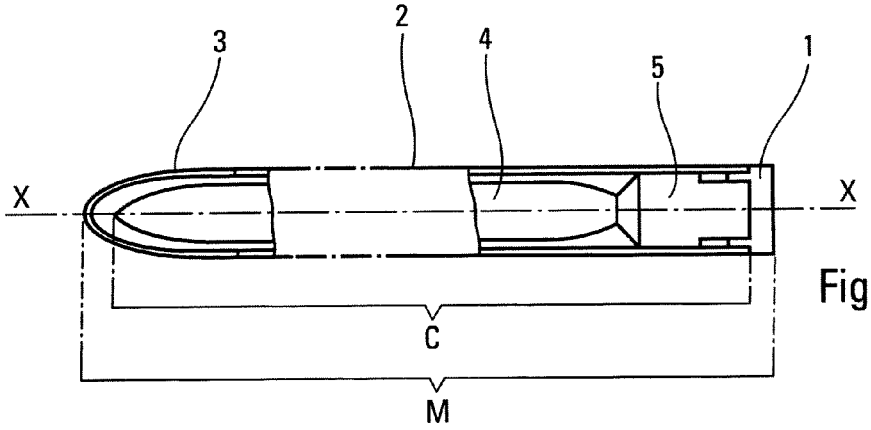
FIG. 1 schematically represents a piece of ammunition with its different component parts.

The piece of ammunition M represented on FIG. 1 is usually made of various cylindrical parts (or stages) assembled according to a longitudinal axis X and denoted here by a shell base or low rear part 1, a tube or central part 2 and cap or high front part 3, inside which there is a composite C comprising a missile 4 (guiding system and military charge being not illustrated) attached to the acceleration and rocking system 5 and which, upon firing of the composite and during the flight trajectory, are caused to be separated.

Figure 2:
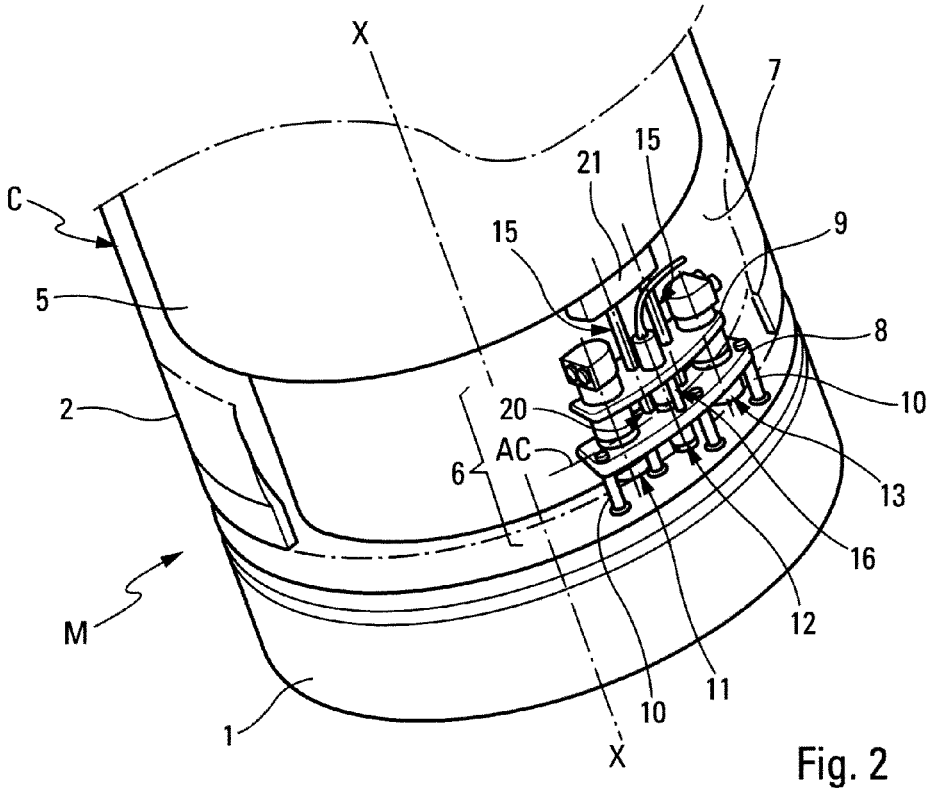
FIG. 2 is a partial enlarged schematic perspective view of the fixture with electrical connections and separable mechanical attachment systems according to aspects of the invention and assembling two of said parts to be separated.

For this, in the illustrated and enlarged embodiment of FIG. 2, the assembly between the shell base 1 and the acceleration and rocking system 5 of the composite C is obtained, in addition to peripheral locks by embedding or similar not represented here, by a specific fixture 6 insuring the electrical connection between the system 5 of the composite and the shell base 1, and the mechanical attachment between the latter, confirming further the electrical connection.

In the illustrated embodiment and on a usual way, the fixture 6 is located in the available internal annular space 7 close to the periphery of the piece of ammunition, between the shell base 1, the acceleration system 5 and the tube 2. It comprises two parallel plates, one 8 being lower and attached to the shell base by ties 10 and the other 9 being higher and designated by floating support (due to its attachment to a missile) and attached to the acceleration system 5, three electrical connectors 11, 12, 13 establishing the electrical communication between the low part 1 of the piece of ammunition, attached to the firing facility, and the acceleration system 5 attached to the missile, and two identical separable mechanical attachment systems 15 holding both plates between them and the electrical connection between the connectors until the moment where, as the firing order is given, they provide the separation of the plates and thus, of the acceleration system 5 and the shell base 1.

Figure 3:
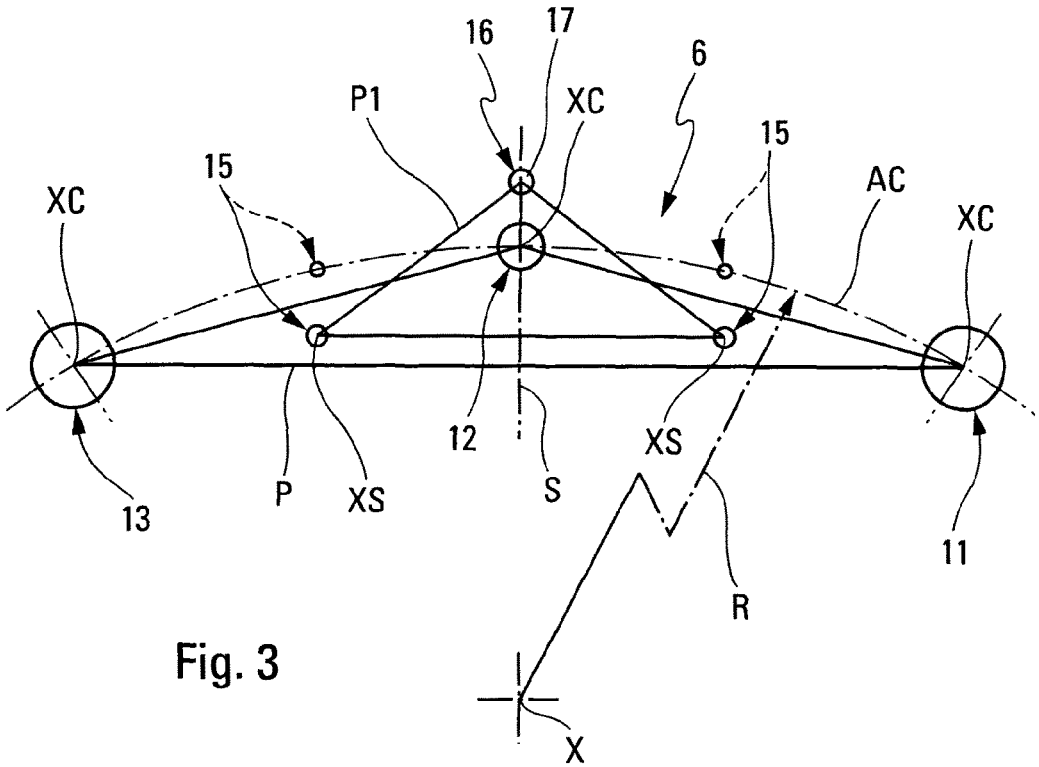
FIGS. 3 and 4 are schematic views in plane and on the side of the fixture according to the device, system, and method.
Figure 6:
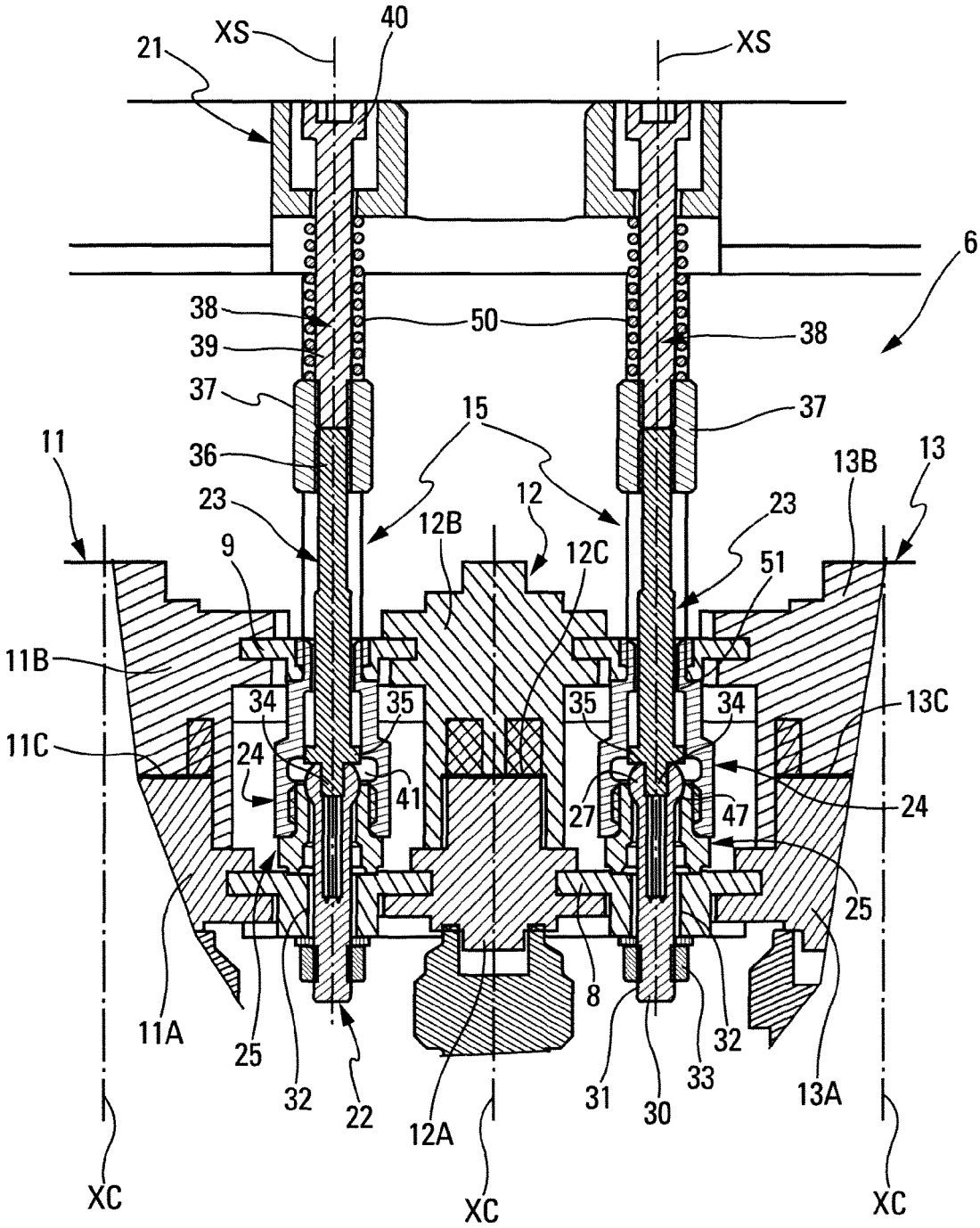

In particular, as shown on FIGS. 2, 3 and 6, the three electrical connectors 11, 12, 13 are parallel between them and to the longitudinal axis X for their connection/disconnection, and are located in plane (particularly to the axis X) according to a same radius R, that is to say they are aligned according to a same circular arc AC (FIGS. 2 and 3) in the internal annular space 7. It is to be noticed that the end connectors 11, 13 are identical and dimensionally bigger than the central connector 12, as above mentioned, and that they are located at the same distance from the central connector and structurally, the three connectors are made of a lower part with a base 11A, 11B, 11C fixedly attached to the lower plate 8 and a higher part with plug 11B, 12B, 13B fixedly attached to the floating support or higher plate 9 (FIGS. 2 and 6). Sealing between those parts is obtained by a rubber element denoted by 11C, 12C, 13C on FIG. 6. The electrical connections of those parts to the supplies and different equipment have not been represented.

Consequently, to avoid the problems met and above mentioned, the two separable attachment systems 15 are offset from the circular arc AC on which there were initially aligned with the three connectors to be located on the side being internal to the circular arc AC towards the longitudinal axis X. Thus, the systems are located in the triangular plane P formed by the three electrical connectors 11, 12, 13 and are closer to the end connectors. FIG. 3 shows the isosceles triangular plane P obtained by joining the geometric axis XC of the connectors, with the axis XS of both separable attachment systems 15 which are located in the triangular plane P being respectively symmetric on both parts of the symmetry axis S of such isosceles triangle.

And an abutment 16 under the form of a rigid stem or similar 17 is located between the two higher 9 and lower 8 plates, parallel to the axis XC of the connectors and X of the piece of ammunition and located outside the circular arc AC perpendicularly to the axis XC of the central connector 12. Consequently, in projection in the plane P of the connectors represented on FIG. 3, the stem 17 of the abutment 16 forms with the axis XS of both separable attachment systems 15, an isosceles triangular plane P1 parallel to the plane P formed by the three connectors 11, 12, 13. In such a way, upon the positioning of the connectors and the attachment systems, an action of the type plane P (connectors) against plane P1 (attachment and abutment systems) is obtained. Consequently, upon the clamping of the systems 15 of the fixture 6, any rocking movement of the plate or floating support 9 is avoided, even with an important stiffness to overcome supplied by the sealing elements 11C and 13C represented on FIG. 6 at the level of the base-plug connection of the corresponding parts 11A-11B. 13A-13B of the end connectors.

Figure 4:
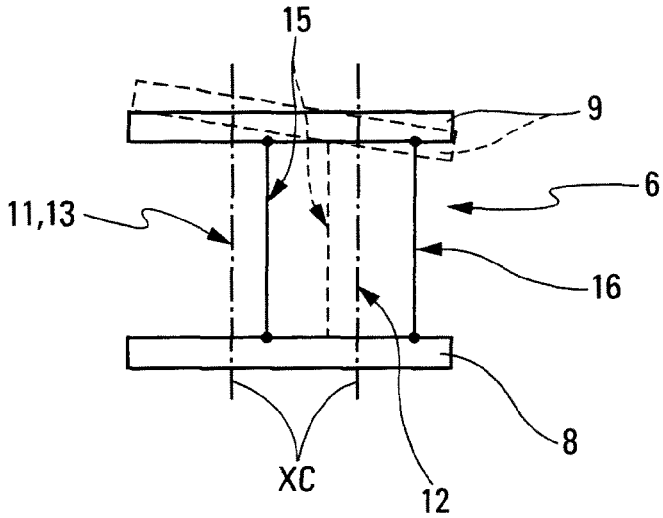

FIG. 4 shows the rocking of the floating support 9, represented on an exaggerated way in dotted line, what happens when both separable attachment systems 15 are located, according to the prior state of the art, on the circular arc AC of the connectors. On the contrary, with an arrangement of the type plane against plane and the attachment systems 15 on the side internal to the circular arc AC, the rocking risk of the floating support 9 and a bad positioning of the fixture 6 are cancelled, both higher 9 and lower 8 plates bearing the connectors and the attachment systems remaining parallel upon the assembling of the fixture.

Figure 5A:
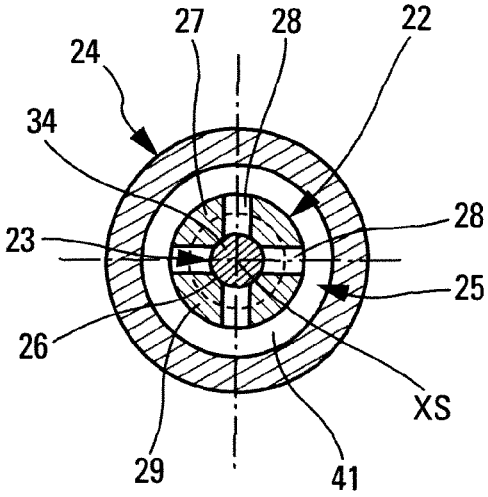
FIG. 5A is a cross-sectional view of the system according to line A-A of FIG. 5.
Figure 5:
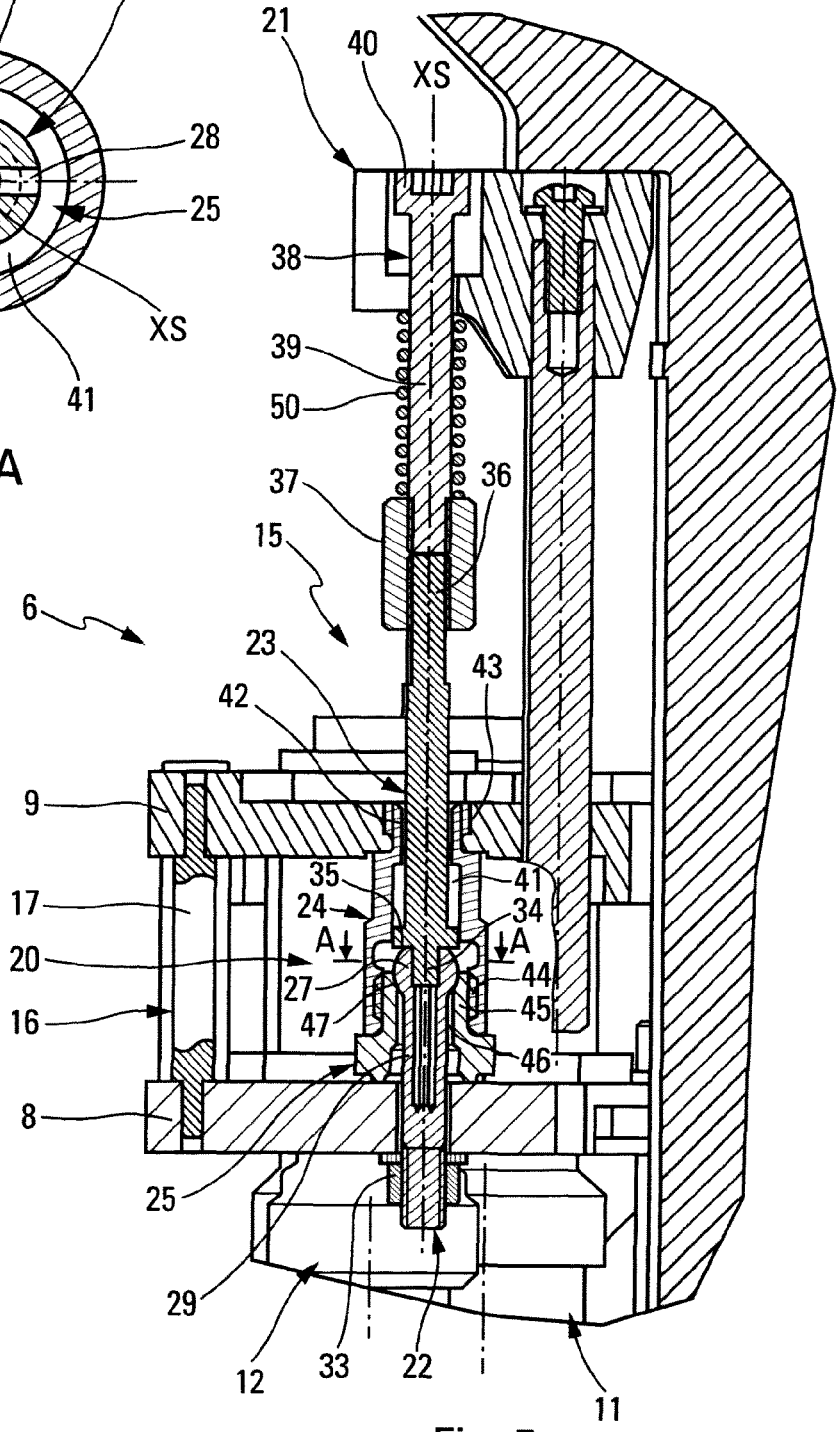
FIGS. 5 and 6 are longitudinal sectional views of the fixture in a locked position of both parts, passing respectively through one of the systems and the abutment and through both systems and the electrical connectors.

As regards the separable mechanical attachment systems 15, a preferred embodiment is represented on FIGS. 5, 5A and 6.

Such an attachment system 15 is largely based, for example, on the system disclosed in the patent application FR 08 06011 in the name of the Applicant and comprises an attachment mechanism 20 with an elastic deformation between the lower plate 8 attached to the shell base 1 and the floating support 9 attached to the acceleration system 5 and a controlled device 21 for the attachment mechanism 20 to cause the separation of the shell base 1 (lower plate) of the acceleration and rocking system 5 (floating support) and assembled parts of the connectors 11, 12, 13.

In particular, the attachment mechanism 20 is made according to the longitudinal axis XS of each system 15 parallel to the axis X of the composite, of an elastically deformable stem 22 attached to the plate 8, a sliding needle 23 attached to the control device 21 and cooperating with the stem, and a cylindrical annular body 24 fastened to the floating support 9 and bearing an element with an axial annular abutment 25 for the elastically deformable stem.

As a reminder, the stem 22 presents an elastically deformable enlarged end which is made under the form of a spherical head 27 having a diameter higher than the stem and presenting two through-slots 28 arranged into longitudinal perpendicular planes to demarcate in such a way for identical quarters or petals, as shown on FIG. 5A. Thus, to provide some elasticity for the end, the slots 28 are extended in the stem 22 beyond the spherical head 27, thereby forming extended fingers (quarters) 29 with a spherical head and being elastically deformable. Thanks to the slots, the fingers 29 can come closer radially between them in the direction of the axis XS and then reduce the initial diameter of the spherical head 27, which occupies an open position on FIGS. 5, 5A and 6, under the least effort, as it will be seen later on. The opposed end of the stem presents a threaded part 31 crossing a hole 32 provided in the lower plate and which receives a clamping nut 33 fastening the stem to the lower plate according to the axis XS.

The needle 23 presents an extended cylindrical shape, an end 34 of which is smooth and is inserted by adjustment in the cylindrical internal channel 26 demarcated by the deformable extended finger 29 with spherical head 27 of the stem. The introduction distance of the smooth end 34 into the spherical head to hold the latter in an initial open position is defined by an external shoulder 35 of the smooth end 34, axially abutting against the enlarged end with spherical head 27 of the stem.

The opposed end 36 of the needle is threaded to be engaged by screwing into a fastening nut 37 connecting the control device 21 to the needle through a screw 38, the threaded stem 39 of which cooperates with the nut to abut against the threaded end 36 of the needle. Thus, the needle 23 and the screw 38 form an assembly connected by the attachment nut 37. An axial play exists between the control device 21 and the head 40 of the screw 38 so as to absorb a few longitudinal movements due to the environment being external to the fixture.

The cylindrical body 24 and the abutment element 25 are located between the floating support 9 and the plate 8. More particularly, the cylindrical body 24 comprises an axial hole 41 being crossed coaxially by the needle 23 and which surrounds the cooperating ends, respectively, with spherical head 27 of the stem and smooth 34 of the needle. Such cylindrical body 34 ends, on the one side, by a thread 42 being screwed in a tapped hole 43 of the floating support 9 and, on the other side, by a tapping 44 provided on the outlet of the axial hole and being screwed in a thread 45 of the element with annular axial abutment 25. The latter has its axial hole 46 in continuity of the body for the passage of the stern, such hole 46 ending, on the side of the needle, by a spherical bearing or cup 47 against which the spherical head 27 of the stem applies. Of course, the dimensions of the bearing 47 and the head 27 are meeting. Thus, the contact between the abutment element 25 and the elastically deformable stem 22 is performed by an annular spherical surface portion allowing a relative angular clearance of the stem 22 attached to the plate 8 with respect to the body 24 connected to the floating support 9 in all directions like a spherical plain bearing. So, it is understood that the clamping of the nut 33 of the stem 22 onto the plate 8 ends to draw the stem against the plate and thus to press the elastically deformable fingers 29 against the spherical bearing 47 and, consequently, to pinch the smooth end 34 of the needle.

The adjustment of the cylindrical body 24 and the abutment element 25 between the floating support 9 and the lower plate 8 is made, after mounting them around the stem 22, by bringing in contact the abutment element 25 against the plate 8 and the body 24 against the support 9 and this, through screwing connection.

Through such arrangement, the holding nut initially provided in the above mentioned application is cancelled and avoids, between others, inherent problems related to the weak thickness of its tapped side wall through which the important attraction effort is passing, which effort occurring upon the separation of each attachment system.

Furthermore, each of the systems 15 comprises moreover a compression spring 50 provided around the screw 38, between the control device 21 and the fastening nut 37. Such compression spring 50 prevents the axial recoil of the needle, thereby avoiding any untimely unlocking of the system before the ammunition launching, due to the fact that such attachment systems 15 are used in severe environment, for example with strong vibrations. Such spring 50 advantageously replaces the elastically deformable ring provided in the prior art and which, due to the suppression of the holding nut, would have been to be moved in the passage hole of the calibrated body, which would have presented blocking risks for the sphere by debris of the ring being blocked between the fingers of the latter, upon the separation of the systems.

The positioning of the fixture 6, after fastening the support plates 8 and 9, respectively, on the shell base 1 and the acceleration system 5, and after screwing the concerned parts 11A, 11B, 12A, 12B. 13A, 13B of the electrical connectors on the latter, shows no difficulties.

In fact, thanks to the arrangement of attachment systems 15 on this side of the circular arc AC and the axial abutment 16 with the stem 17 between the plates, thereby forming a plane P1 parallel to the plane P of the connectors, the parallel axial efforts of the systems to overcome the stiffness of the sealing elements 11C, 12C, 13C of the connectors, especially the end ones, and make the attachment mechanism 20 integral, go then perpendicularly to the plane of the connectors. In such a way, the floating support or higher plate 9 does not rock and stays parallel to the lower plate 8. Concerning the attachment mechanisms 20 of the systems, the smooth ends 34 of the needle 23 are then inserted into the channel 26 of the elastically deformable spheres 27 supported by the abutment elements 25 with a spherical bearing 47 of the bodies 24, preventing the withdrawal thereof and locking the fixture 6.

The switching of the latter from the locked position (FIGS. 5, 5A, 6) to the unlocked position (FIG. 7) is performed substantially as before and will only be disclosed briefly.

Upon the firing of the ammunition further to a firing order, some information of which run through the electrical connectors, the control device 21 of each attachment systems 15 (integral with the acceleration system 5 being then started) starts its axial displacement or sliding according to the arrow F (FIG. 7), neutralizes the play between the head 40 of the screw 38 and the latter and draws on the needle 23. The generated traction effort is such that it allows the extraction of the smooth end 34 from the spherical head 27 and the movement is continued up to the moment where the shoulder 35 of the needle 23 comes in contact with the cross bottom 51 of the body 24. The attachment mechanisms 20 are then unlocked, but not separated. The parts of the connectors are still connected and the compression spring 50 is progressively extended.

The displacement continues and the needle 23 of each system 15 drives with it, through the contact of the shoulder 35, the cylindrical body 24 and the associated abutment element 25. Contrarily to the preceding embodiment for which the needle draws on the holding nut (removed here), which draws through its limited thread the whole assembly, each needle pushes the body against the floating support 9 and the whole is then drawn with no difficulty. Under the action of the spherical bearing 47 of the element 25 deviating from the stem 23, the elastically deformable fingers 29 progressively radially convert together in the direction of the axis XC up to touch themselves when the axial hole 46 of the element with an annular abutment 25 reaches and passes over the spherical head 27 of said stem. The spherical head then occupies the closed position and the attachment mechanisms 20 of the attachment systems 15 are unlocked.

Figure 7:
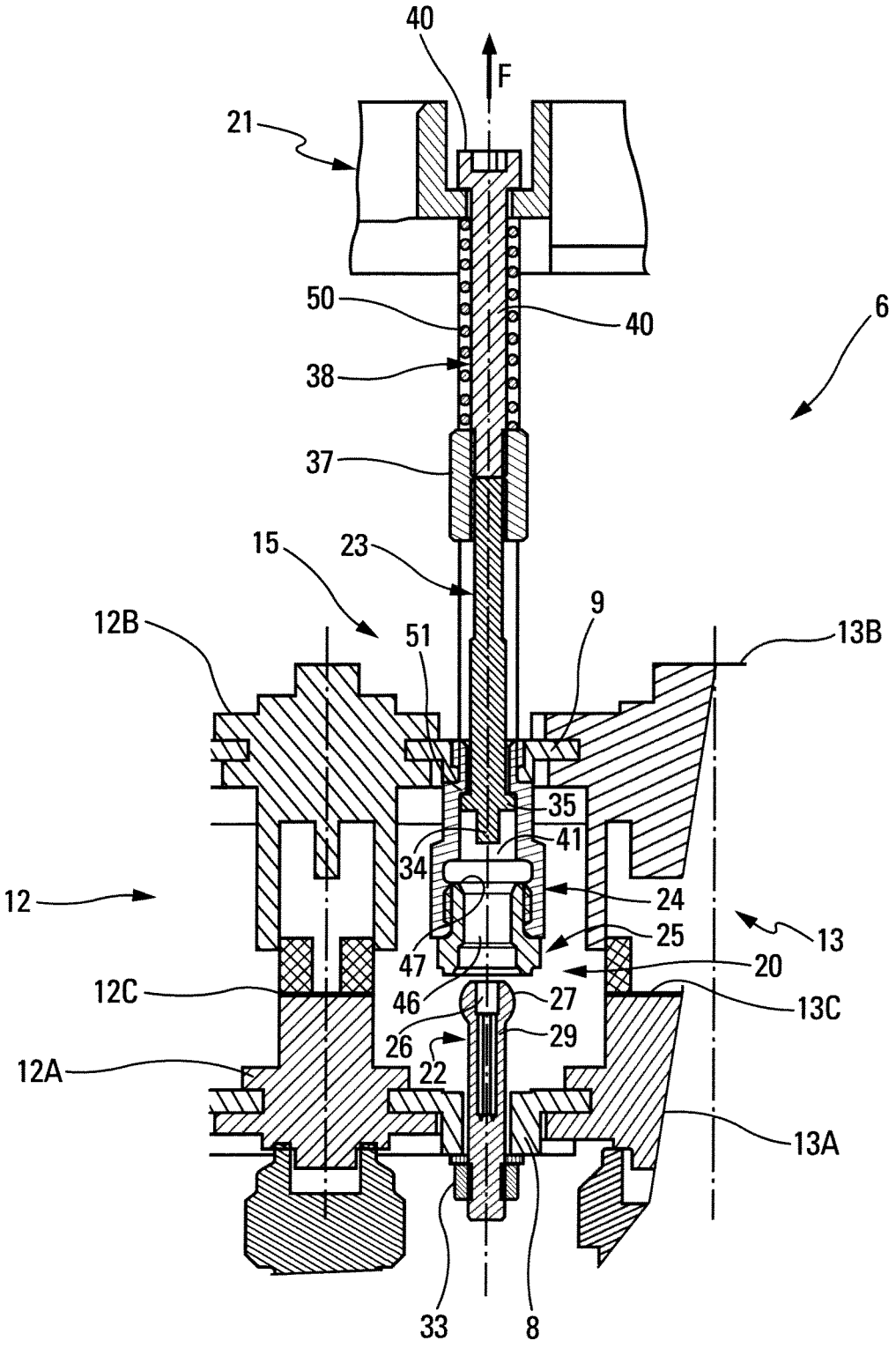
FIG. 7 shows in a longitudinal section the fixture in a separate position of both parts.

The separation of the fixture 6 is then acquired and continues, that it to say, that, as shown on FIG. 7, the floating support 9 fastened to the acceleration system 5 and the support plate 8 fastened to the shell base 1 are released from each other, as well as the parts 11A, 12A, 13A of the parts 11B, 12B, 13B of the connectors are screwed respectively on the plate 8 and the floating support 9. The shell base is definitely separated of the rest of the piece of ammunition.

Of course, as long as firing of the latter is not ordered, it is possible to disassemble and then to assemble again the fixture after its positioning, for maintenance purposes especially.

The invention claimed is:

1. A fixture with electrical connections and separable mechanical attachment systems for assembling two cylindrical components with a common longitudinal axis, of the type comprising:

two support plates respectively inserted facing one another on the components substantially on the periphery of the latter;

at least three electrical connectors each in two parts, mounted in parallel between them and aligned in a circular arc (AC) with respect to said longitudinal axis on said support plates, each of them bearing the corresponding parts of the connectors, and between the three electrical connectors, parallel to the latter, two separable mechanical attachment systems fixedly connecting said support plates by locking said parts of the connectors, wherein both separable attachment systems are located being offset from said circular arc (AC), on the internal side of the latter and are arranged, in a projection perpendicular to said longitudinal axis, in the triangular plane (P) formed by the three electrical connectors being aligned in a circular arc.

2. The fixture according to claim 1, wherein it comprises moreover an axial abutment parallel to the separable mechanical attachment systems and arranged between the two support plates to form with both separable attachment systems a plane (P1) being parallel to the triangular plane (P) formed by the three electrical connectors.

3. The fixture according to claim 2, wherein said axial abutment is located in a projection perpendicular to said longitudinal axis ahead the central electrical connector beyond said the circular arc (AC) on the side being external to the latter.

4. The fixture according to claim 2, wherein said axial abutment is present under the form of a stem fixedly attached by the ends thereof between the two support plates.

5. The fixture according to claim 1, wherein the two attachment systems are located closer to the two electrical end connectors.

6. The fixture according to claim 1, wherein each separable mechanical attachment system comprises an attachment mechanism for said components and a control device for said attachment mechanism so as to cause the separation of said components, said attachment mechanism being provided with an elastic deformation and comprising according to a longitudinal axis at least:

a stem having an enlarged end with a longitudinally slit spherical head being elastically deformable and fastened, on the other end thereof, to the plate of one of said components;

a needle being axially movable, an end of which is inserted into said spherical head of the stem to maintain it in an open position and the other end of which is connected to said control device; and a body with an axial hole, fastened to the plate of the other component and surrounding said cooperating ends of the stem and the needle, while being axially attached to the latter and comprising, in said hole, an axial ring abutment against which said spherical head of the stem applies; and said control device being moved with an axial displacement according to said longitudinal axis and acting on said needle of the attachment mechanism to deviate it from said enlarged end with spherical head of the stem and, through the action of said abutment of the body attached to said needle being moved, to switch said elastically deformable spherical head from its open position to a closed position and allow the relative passage of said stem through said abutment of the body.

7. The fixture according to claim 6, wherein the attachment of said needle to said control device comprises a fastening nut receiving the threaded end of the needle opposite the one inserted into said stem, and a screw of said device, and around said screw, between said control device and the fastening nut, a compression spring is provided to axially hold forcibly in position said needle in the spherical head of the stem.

8. The fixture according to claim 6, wherein said spherical head comprises at least two slots arranged in perpendicular longitudinal planes by separating said spherical head in four identical elastically deformable quarters, at the center of which the corresponding end of said needle can be inserted to hold it in an initial open position.

9. The fixture according to claim 6, wherein said axial abutment of the body defines a spherical annular bearing being complementary of the spherical head and is formed by an annular element mounted around said stem and attached by screwing to said body.

* * * * *